US010473316B2

(12) United States Patent
Smits et al.

(10) Patent No.: US 10,473,316 B2
(45) Date of Patent: Nov. 12, 2019

(54) LIGHT EMITTING DEVICE WITH HEAT CONDUCTING FLUID

(71) Applicant: SIGNIFY HOLDING B.V., Eindhoven (NL)

(72) Inventors: Albertus Adrianus Smits, Eindhoven (NL); Dmitri Anatolievich Chestakov, Eindhoven (NL); Hendrik Jan Eggink, Eindhoven (NL); Ralph Theodorus Hubertus Maessen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/505,289

(22) PCT Filed: Aug. 5, 2015

(86) PCT No.: PCT/EP2015/068005

§ 371 (c)(1),
(2) Date: Feb. 21, 2017

(87) PCT Pub. No.: WO2016/026695

PCT Pub. Date: Feb. 25, 2016

(65) Prior Publication Data

US 2017/0261194 A1 Sep. 14, 2017

(30) Foreign Application Priority Data

Dec. 23, 2014 (EP) ..... 14199929

(51) Int. Cl.
*F21V 29/56* (2015.01)
*F21V 29/503* (2015.01)
(Continued)

(52) U.S. Cl.
CPC ..... *F21V 29/56* (2015.01); *F21K 9/00* (2013.01); *F21K 9/60* (2016.08); *F21V 29/503* (2015.01);
(Continued)

(58) Field of Classification Search
CPC ... F21K 9/23; F21K 9/232; F21K 9/27; F21K 9/275; F21K 9/66; F21S 4/26; F21S 4/28;
(Continued)

(56) References Cited

U.S. PATENT DOCUMENTS 5,890,794 A * 4/1999 Abtahi ..... B60Q 7/00 362/294
8,262,249 B2 * 9/2012 Hsia ..... F21V 25/04 362/217.1
(Continued)

FOREIGN PATENT DOCUMENTS

CN 201339887 U 11/2009
CN 201892047 U 7/2011
(Continued)

*Primary Examiner* — Anh T Mai
*Assistant Examiner* — Steen Y Horikoshi
(74) *Attorney, Agent, or Firm* — Akarsh P. Belagodu

(57) ABSTRACT

The invention relates to a light emitting device, comprising at least one light source (101) and a closed container, the container comprising a first area (105) and a second area (107) that is arranged opposite to the first area (105), the closed container being filled with a heat conducting fluid (111) that is thermally coupled to an inside surface of the closed container, wherein the at least one light source (101) is arranged on an outside surface (115) of the first area of the closed container and thermally coupled to the inside surface (113) of the closed container.

16 Claims, 14 Drawing Sheets

(51) Int. Cl.
*F21K 9/00* (2016.01)
*F21K 9/60* (2016.01)
*F21V 29/506* (2015.01)
*F21Y 115/10* (2016.01)

(52) U.S. Cl.
CPC ..... *F21V 29/506* (2015.01); *F21Y 2115/10* (2016.08)

(58) Field of Classification Search
CPC .... F21V 29/002; F21V 29/004; F21V 29/006; F21V 29/30; F21V 29/50; F21V 29/503; F21V 29/506; F21V 29/51; F21V 29/56–60; F21V 29/65
See application file for complete search history.

(56) References Cited

U.S. PATENT DOCUMENTS 8,587,185 B2 11/2013 Negley et al.
2005/0254264 A1* 11/2005 Sidwell ..... F21V 3/00 362/655
2006/0274524 A1* 12/2006 Chang ..... F21K 9/00 362/231
2009/0154164 A1 6/2009 Hsu et al.
2009/0207586 A1* 8/2009 Arai ..... G02B 5/021 362/97.1
2010/0170670 A1 7/2010 Catalano
2011/0172976 A1 7/2011 Budiman et al.
2011/0267805 A1* 11/2011 Hua ..... F21S 6/005 362/101
2012/0250333 A1 10/2012 Chou
2012/0294001 A1* 11/2012 Rehn ..... F21V 29/30 362/235
2013/0170175 A1* 7/2013 Negley ..... F21V 29/004 362/84
2014/0268744 A1* 9/2014 Nourbakhsh ..... F21V 3/02 362/235
2015/0085492 A1* 3/2015 Kato ..... F21V 19/005 362/294

FOREIGN PATENT DOCUMENTS

CN 202141017 U 2/2012
CN 102943967 A 2/2013
CN 203068250 U 7/2013
DE 541952 C1 1/1932
DE 102005013208 A1 10/2005
JP 3180295 A2 8/1991
JP H110316488 A2 12/1998
JP 2006108010 A 4/2006
JP 2012516540 A 7/2012
JP 2013105711 A 5/2013
JP 201441750 A 3/2014
JP 2014102995 A 6/2014
WO 2008133304 A1 11/2008
WO WO2013082803 A1 6/2013
WO 2014068335 A1 5/2014

* cited by examiner

LIGHT EMITTING DEVICE WITH HEAT CONDUCTING FLUID

CROSS-REFERENCE TO PRIOR APPLICATIONS

This application is the U.S. National Phase application under 35 U.S.C. § 371 of International Application No. PCT/EP2015/068005, filed on Aug. 5, 2015, which claims the benefit of European Patent Applications Nos. 14199929.2, filed on Dec. 23, 2014 and 14181742.9, filed on Aug. 21, 2014. These applications are hereby incorporated by reference herein.

TECHNICAL FIELD

The invention relates to a light emitting device. The invention further relates to a heat sink for said light emitting device. The invention further relates to a lamp comprising said light emitting device. The invention further relates to a luminaire comprising said light emitting device or said lamp.

BACKGROUND ART

The issue of heat management of LEDs (light emitting diodes) in lamps is known in the art. LED based solutions are less than 100% efficient. The heat that is generated during operation generally leads to temperatures in the application that may deteriorate the system efficacy and may limit the lifetime of the LEDs and/or other components. In order to transfer heat to the ambient, LED devices generally use a metal heat sink. In most LED applications the heat sink and the light emitting area are two separate elements. The size of the heat sink is in general smaller than the total lamp enclosure, limiting the heat transfer to the ambient and thus the thermal performance. In addition, heat sinks are generally relatively heavy and relatively expensive. Furthermore, heat sinks are generally not optically transparent.

U.S. Pat. No. 8,454,185 B2 discloses a liquid-cooled LED lamp having an outer lamp shade, an inner hollow container, and a plurality of LEDs positioned on a substrate in the space between the inner hollow container and the outer lamp shade. Said space is filled with a heat conducting liquid for conducting heat generated by the LED to the outer lamp shade. A disadvantage of this lamp is that measures have to be taken in order to prevent that electrical components will be in direct contact with the heat conducting liquid. Furthermore, heat transfer to the surroundings may be hampered as the LEDs that are present in the liquid may limit circulation of the liquid in the space. Furthermore, materials that are used in the LEDs, for example luminescent materials such as inorganic phosphors, organic phosphors or quantum dots, may be susceptible to degradation in case these materials become in contact with the heat conducting fluid.

The suggested systems thus seem to suffer from thermal management problems which may only be solved (partially) at the cost of optical properties. Vice versa, when optimizing optical properties, thermal management is a problem.

DISCLOSURE OF INVENTION

It is an object of the invention to provide an alternative light emitting device, which preferably further at least partly obviates one or more of above-described drawbacks.

This object is achieved with a light emitting device according to the invention, comprising at least one light source and a closed container, the closed container comprising a first area and a second area that is arranged opposite to the first area, the container being filled with a heat conducting fluid that is thermally coupled to an inside surface of the closed container, wherein the at least one light source is arranged on an outside surface of the first area of the closed container and thermally coupled to the inside surface of the closed container. The liquid in the container absorbs the heat generated by the light source and is acting as a heat spreader to spread the heat over the outer surface of the light emitting device. Due to the buoyancy forces resulting from the temperature differences within the fluid between the relative hot spots in the fluid close to the LEDs and the relative cold spots in the fluid close to the second area of the container, the fluid moves inside the container during operation of the light emitting device, improving the heat transfer to the surroundings. As a result the container with the heat conducting fluid will act as a heat sink to transfer the heat generated by the LEDs to the surroundings. As the LEDs are not positioned inside the container, the movement of the fluid is not hampered by the LEDs. In this way the heat can be released to the surroundings via a relative large surface area of the container. In addition, the LEDs are not in direct contact with the fluid which reduces the risk on short-circuiting. No further metal heat sink is required, for example a commonly used metal heatsink, resulting in less risk for interaction with electromagnetic field, X-rays or gamma radiation. Furthermore, the weight of the light emitting device can be reduced by the proper choice of the fluid as most fluids will have a lower density than the materials commonly used for heat sinks.

US2009/0154164A1 discloses an underwater lamp including a cylindrical shaped shell with two opposite ends being open, a lens being received at one of the two opposite ends of the shell, and a sink base attached to the other one of the two opposite ends of the shell. An interior space is defined among the shell, the sink base, and the lens. A light generating element is positioned in the interior space and thermally attached to the sink base. The lamp has two openings through which water flows into the interior space. The heat of the LED is primarily transferred to the sink base and further conducted to a plurality of fins.

DE541952 discloses a lighting device for projection lighting with a light source embedded in a cooling cuvette having a reflecting layer. The light is coupled into the cooling cuvette and reflected to an exit window. The cooling cuvette has openings for providing a flow of cooling fluid through the cooling cuvette. The lamp is embedded in the cooling cuvette in order to provide cooling by the cooling fluid.

An embodiment of the invention is characterized in that the heat conducting fluid is light transmissive (i.e. a "light transmissive fluid"), and in that at least a part of the first area and the second area are light transmissive. At least a part of the light generated by the light source may pass through the fluid before exiting the light emitting device via the second area. More freedom is obtained for the optical design of the light emitting device. The fluid and/or container may be used for beamshaping of the light or to create other light effects.

An embodiment of the invention is characterized in that the container comprises a first circular plate as the first area and a second circular plate as the second area, the second circular plate positioned at a distance from the first cylindrical plate of more than zero nun, and wherein the space between the first circular plate and the second circular plate is filled with the heat conducting fluid. In this embodiment light may be generated by a relatively large area without the need of a relatively complex construction of metal heat sinks An embodiment of the invention is characterized in that the container comprises a first tubular vessel as the first area and a second tubular vessel as the second area, the second tubular vessel surrounding the first tubular vessel at a distance larger than zero mm, and wherein the space between the first tubular vessel and the second tubular vessel is filled with the heat conducting fluid. In this embodiment, the heat generated by the light source is transferred to the liquid and due to the buoyancy forces, the locally heated fluid starts to move. Finally, this results in a global circulation of the fluid inside the cylindrical vessel without the use of mechanical actuation (so-called thermosyphon effect) . The tubular shape of the first and second vessel improves the mechanical strength of the light emitting device which may be of importance for light emitting devices having a relatively high output power that would require a relatively large heat sink.

An embodiment of the invention is characterized in that the container comprises a first spherical vessel as the first area and a second spherical vessel as the second area, the second spherical vessel surrounding the first spherical vessel at a distance larger than zero mm, and wherein the space between the first spherical vessel and the second spherical vessel is filled with the heat conducting fluid. In this embodiment, a device is obtained that substantially generates light in all directions. In addition, such device can be used in retrofit lamps. The spherical shape of the first and second vessel improves the mechanical strength of the light emitting device which may be of importance for light emitting devices having a relatively high output power that would require a relatively large heatsink.

An embodiment of the invention is characterized in that the distance $d_1$ is in the range of 1-10 mm, more preferably in the range of 1-7 mm, even more preferably in the range of 2-7 mm, even more preferably in the range between 2-4 mm. A relatively thin layer of fluid leads to a relatively low-weight light emitting device. Furthermore, a relatively thin layer of fluid may be beneficial for the optical properties of the light emitting device while still providing sufficient capacity for transportation of the heat.

An embodiment of the invention is characterized in that the heat conducting and optically transparent fluid has a Grashof number in the range between $5\cdot10^8$-$3\cdot10^{10}$, more preferably in the range between $6\cdot10^9$-$3\cdot10^{10}$, even more preferably in the range between $1\cdot10^{10}$-$3\cdot10^{10}$. The Grashof number (Gr) is a known dimensionless number in fluid dynamics and heat transfer, that approximates the ratio of the buoyancy to viscous force acting on a fluid. The fluids according to this embodiment, when heated during operation of the light emitting device, will start to circulate relatively easy and have relatively good properties for transportation of the heat. In general, the higher the Grashof number of the fluid is, the better properties it will have for application in the present invention.

An embodiment of the invention is characterized in that the heat conducting fluid is selected from the group comprising silicon oil, methanol, ethanol, acetone, water, a fluorinated aliphatic organic compound, an aromatic organic compound and dimethylpolysiloxane. These fluids are especially suitable for the creation of the thermosyphon effect due to their relatively large thermal expension coefficient.

An embodiment of the invention is characterized in that at least a part of the container is made of one or more materials selected from the group comprising a light transmissive organic material, a glass material, a light transmissive ceramic material and a silicone material. These materials are light transmissive and allow having sufficient freedom for the optical design of the light emitting device.

An embodiment of the invention is characterized in that the light source comprises at least one Light Emitting Diode (LED). The heat in a LED is produced in a relatively small volume and in this way that heat can be spread out over a relatively large area. The LED may be present, for example, as a single LED, multiple LEDs, a strip with multiple LEDs or a Chip-On-Board LED source.

An embodiment of the invention is characterized in that the light source comprises at least one array of light emitting diodes positioned substantially parallel to a longitudinal axis of the first tubular vessel and wherein the distance between two neighboring light emitting diodes is in the range of 5-15 mm, preferable in the range of 7-13 mm, more preferably in the range of 8-12 mm. The embodiment allows creating an elongated device that can be used as a TL replacement (retrofit) tube, for example. Having the LEDs sufficiently close to each other will improve the uniformity of the light output by reducing the spots in between the LEDs that may have a lower light output compared to the spots more close to the LEDs.

An embodiment of the invention is characterized by at least three arrays of light emitting diodes positioned substantially parallel to a longitudinal axis of the first tubular vessel, and wherein the three arrays are positioned in a non-symmetrical distribution along the radius of the first tubular vessel. In this embodiment a more uniform light output is obtained and it is beneficial for a good circulation of the liquid inside the vessel during operation of the device caused by the buyoyancy forces.

An embodiment of the invention is characterized in that the heat conducting fluid and/or at least a part of the container comprises particles selected from the group comprising scattering particles and inorganic luminescent particles, or a combination thereof. Use of scattering particles allows to modify the optical properties of the light emitting device and, for example, to diffuse the light that is generated by the light emitting device. Use of inorganic luminescent particles allows to change the color of at least part of the light emitted by the light source in order to generate white light of a desired color temperature or to create colored light. As the luminescent particles are not directly positioned on the light source itself, heating of the luminescent material by the light source is prevented. Furthermore, the heat generated by the luminescent particles during the light conversion can be transferred to the liquid and/or the container.

An embodiment of the invention is characterized in that the container comprises one or more optical elements for directing the light emitted during operation of the device in a predetermined direction. Use of the optical element(s) allows beamshaping of the light generated by the light emitting device according to the desired application, for example for use as a spot light, outdoor illumination or in projection systems.

According to the invention a heatsink comprises a closed container, the closed container comprising a first area and a second area that is arranged opposite to the first area the closed container being filled with a heat conducting fluid that is thermally coupled to an inside surface of the closed container. The heat sink is capable of spreading the heat over a relatively large area, while simultaneously providing freedom in optical design. It has a potentially lower weight than metal heat sinks.

According to the invention a lamp comprises at least one light emitting device according to the invention. According to the invention a luminaire comprises at least one light emitting device according to the invention, or a lamp according to the invention. The invention allows creating a relatively light-weight lamp or luminaire with sufficient freedom in optical design.

Especially, the material of the closed container may comprise one or more materials selected from the group consisting of a light transmissive organic material support, such as selected from the group consisting of PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethylene terephthalate (PET), (PETG) (glycol modified polyethylene terephthalate), PDMS (polydimethylsiloxane), and COC (cyclo olefin copolymer). However, in another embodiment the material of the container may comprise an inorganic material. Preferred inorganic materials are selected from the group consisting of glasses, (fused) quartz, transmissive ceramic materials, and silicones. Also hybrid materials, comprising both inorganic and organic parts may be applied. Especially preferred are PMMA, transparent PC, or glass as material for the material of the first envelope and/or the material of the second envelope. Hence, the container comprises a material independently selected from the group consisting of glass, a translucent ceramic, and a light transmissive polymer.

An embodiment of the invention is characterized in that the material of the closed container has a light transmission in the range of 50-100%, especially in the range of 70-100%, for light generated by the light source. In case the light source is generating visible light, in this way the container is transmissive for the visible light from the light source. Herein, the term "visible light" especially relates to light having a wavelength selected from the range of 380-780 nm. The transmission or light permeability can be determined by providing light at a specific wavelength with a first intensity to the material and relating the intensity of the light at that wavelength measured after transmission through the material, to the first intensity of the light provided at that specific wavelength to the material (see also E-208 and E-406 of the CRC Handbook of Chemistry and Physics, 69th edition, 1088-1989).

An embodiment of the invention is characterized in that, the heat conducting fluid may comprise water, silicon oil, methanol, ethanol, acetone, water, a fluorinated aliphatic organic compound, an aromatic organic compound and silicone, or mixtures of two or more of these compounds.

An embodiment of the invention is characterized in that the optical refractive index of the heat conductive fluid ($n_{fluid}$), and the optical refractive index of at least a part of the material of the container ($n_{container}$) are tuned to each other for modifying the optical properties of the heat sink and the light emitting device. For example, at least a part of the container comprises a material with an optical refractive index in the range of 1-5. The material used for the heat conductive and light transmissive fluid has an optical refractive index in the range of 1-5.

An embodiment of the invention is characterized in that the optical refractive index of the fluid is comparable to the optical refractive index of the material of at least a part of the container ($n_{fluid} \approx n_{container}$). In case the light propagates through the fluid, subsequently through the second area of the container and then exits the light emitting device, the light will not be substantially refracted by the material of the second area of the container and the light emitting device may generate diffuse light. A further embodiment of the invention is characterized in that the optical refractive index of the fluid is larger than the optical refractive index of at least a part of the container ($n_{fluid} > n_{container}$). In case the light propagates through the fluid, subsequently through the second area of the container and then exits the light emitting device, the light will be substantially refracted by the material of the second area of the container and the light emitting device may generate beam shaped light. The amount of beamshaping is determined by the ratio of $n_{fluid}$ to $n_{container}$; at increasing ratio, for $n_{fluid} > n_{container}$, the amount of beamshaping increases. Another further embodiment of the invention is characterized in that the optical refractive index of the fluid is smaller than the optical refractive index of at least a part of the container ($n_{fluid} < n_{container}$). In case the light propagates through the fluid, subsequently through the second area of the container and then exits the light emitting device, a substantial part of the light will be reflected back by the second area of the container and may exit the light emitting device via the first area of the container. The amount of reflected light is determined by the ratio of $n_{fluid}$ to $n_{container}$; at decreasing ratio, for $n_{fluid} < n_{container}$, the amount of reflected light increases. By tuning the optical refractive index of the heat conductive fluid, and the refractive index of at least a part of the container the optical properties of the heat sink and the light emitting device may be altered. The term "light source" may relate to one light source or to a plurality of light sources, such as 2-20 light sources, though in specific embodiments much more light sources may be applied, such as 10-1000. The light source may be a solid state light source or a plurality of solid state light sources. A solid state light source may for example be a LED (Light Emitting Diode), a laser diode, an organic light-emitting diodes (OLED), or a polymer light-emitting diodes (PLED). When more than one light source is applied, optionally these may be controlled independently, or subsets of light source may be controlled independently. The light source is configured to generate visible light or UV light, either directly or in combination with a light converter especially integrated in the solid state light source, such as in a dome on a LED die or in a luminescent layer (such as a foil) on or close to a LED die. The light source may also comprise an incandescent lamp, a high density discharge lamp, or a low-pressure discharge lamp.

In yet another embodiment, the lamp includes at least two subsets of solid state light sources. Optionally, the two or more subsets may be controlled individually (with a (remote) controller).

The terms "upstream" and "downstream" relate to an arrangement of items or features relative to the propagation of the light from a light generating means (here the especially the light source), wherein relative to a first position within a beam of light from the light generating means, a second position in the beam of light closer to the light generating means is "upstream", and a third position within the beam of light further away from the light generating means is "downstream".

The term "heat conducting fluid" means a liquid or a gas that is capable of conducting heat. The term "light transmissive fluid" means a liquid or a gas that has a light transmission in the range of 50-100%, especially in the range of 70-100%, for light generated by the light source.

The inorganic luminescent particles may comprise one or more luminescent materials. Examples of luminescent materials are, amongst others: $M_2Si_5N_8:Eu^{2+}$, wherein M is selected from the group consisting of Ca, Sr and Ba, even more especially wherein M is selected from the group consisting of Sr and Ba; $MAlN_3:Eu^{2+}$, wherein M is selected from the group consisting of Ca, Sr and Ba, even more especially wherein M is selected from the group consisting of Sr and Ba; $M_3A_5O_{12}:Ce^{3+}$ luminescent material, wherein M is selected from the group consisting of Sc, Y, Tb, Gd, and Lu, wherein A is selected from the group consisting of Al and Ga. Preferably, M at least comprises one or more of Y and Lu, and A at least comprises Al. In alternative embodiments, quantum dot based materials are used as luminescent material. For example, a macro porous silica or alumina particle that is filled with polymer matrix material comprising quantum dots may be used. The quantum dots may be II-VI quantum dots, especially selected from the group consisting of (core-shell quantum dots, with the core selected from the group consisting of) CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe and HgZnSTe, even more especially selected from the group consisting of CdS, CdSe, CdSe/CdS and CdSe/CdS/ZnS. The marco porous silica or alumina particles may coated with an inorganic coating, for example provided via atomic layer deposition, to reduce the exposure of the quantum dots to oxygen and/or the heat conducting fluid.

The light emitting device, lamp or luminaire may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, or LCD backlighting. In addition, the light emitting device, lamp or luminaire may be part of or may be applied in e.g. air or water purification systems.

Especially, fields of application are: consumer lamps (e.g. candles, bulbs, spot lights, retrofit TL lamps); professional lamps (especially street light lamps); consumer luminaires (indoor); professional luminaires (e.g. indoor spots, outdoor luminaries); street lights: integrated amp-luminaire designs; special lighting: extreme environments (e.g. pigsties with ammonia levels, disinfection lamps, luminaires for environments with X-Ray or gamma radiation such as nuclear power plants), or underwater lighting (glass is watertight and can be easily coated to prevent organic growth); etc.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

SHORT DESCRIPTION OF FIGURES

DESCRIPTION OF EMBODIMENTS

Figure 1A:
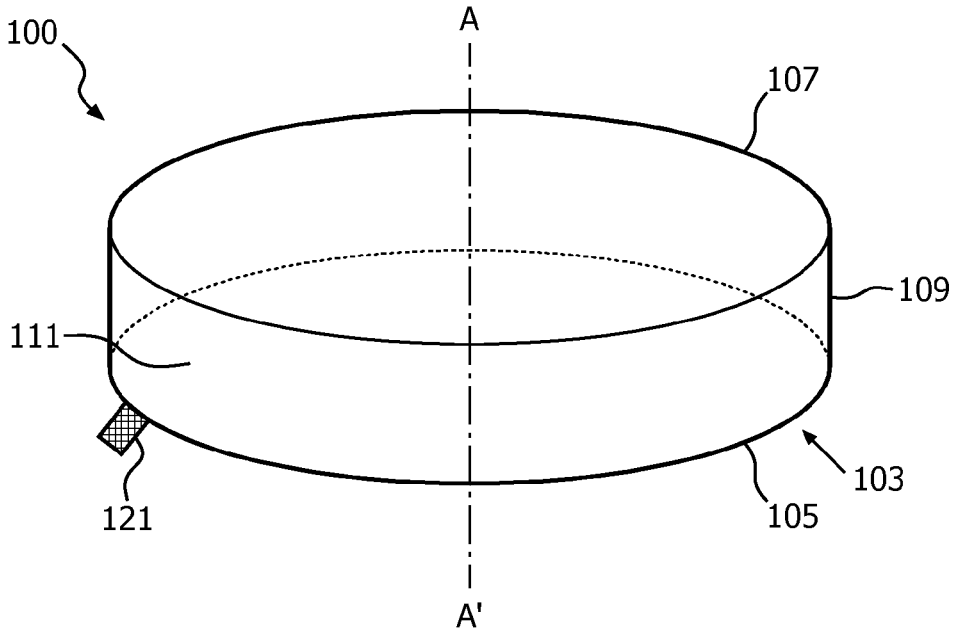
FIGS. 1A, 1B, 1C, 1D and 1E show a first, second, third and fourth embodiment of a light emitting device according to the invention.
Figure 1B:
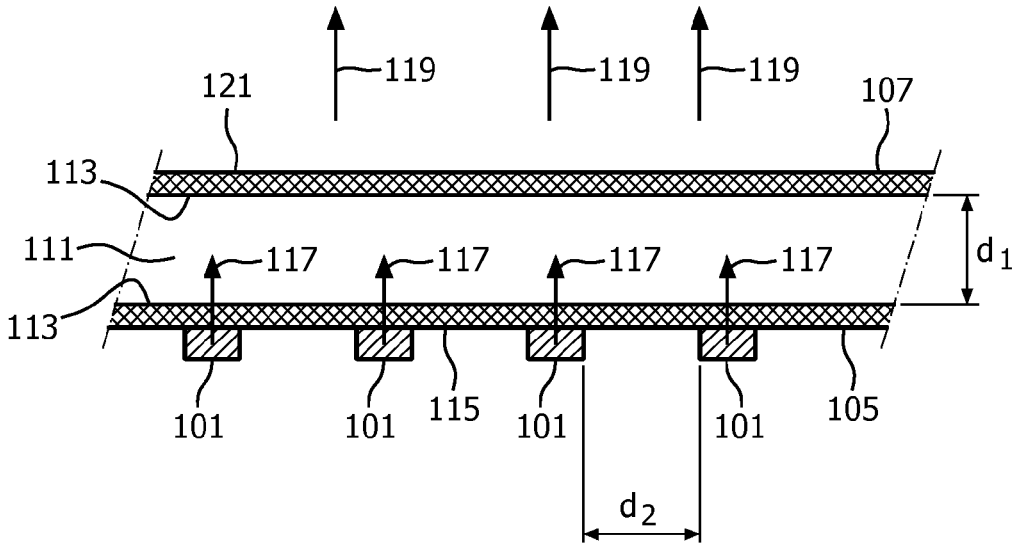
Figure 1C:
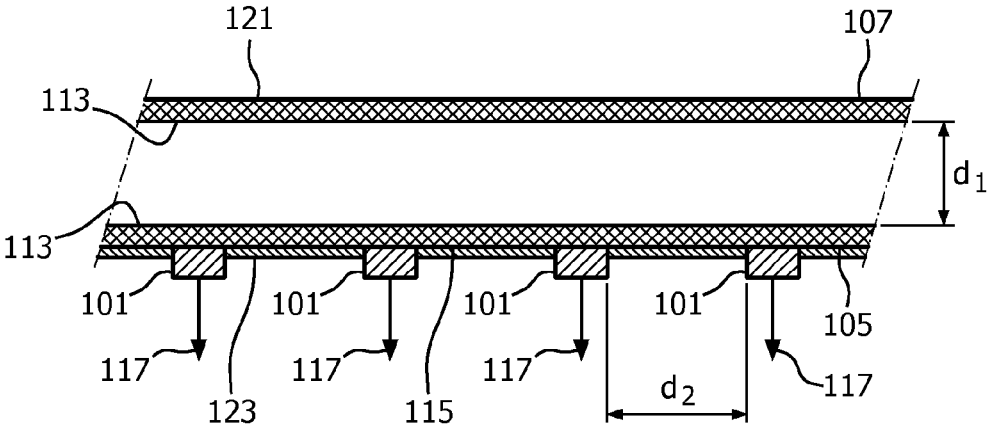

FIG. 1A shows a light emitting device 100, and in FIG. 1B, 1C, 1D and 1E cross sectional views of the light emitting device 100 along the line A-A' (FIG. 1A) are shown. Referring to FIGS. 1A, 1B, 1C, 1D and 1E, the light emitting device 100 comprises a closed cylindrical vessel 103. The cylindrical vessel 103 is formed by a first circular plate 105 and a second circular plate 107 that are connected via a wall 109. The cylindrical vessel 103 is filled with a heat conducting and a light transmissive fluid 111 that is in thermal contact with the inner surface 113 of the first circular plate 105 as well as the second circular plate 107. A plurality of LEDs 101 is positioned on the outer surface 115 of the first circular plate 105 and thermally coupled to the inner surface 113 via the wall of the first circular plate 105. The LEDs 101 are electrically connected to an electrical connector 121. During operation of the light emitting device 100, the LEDs 101 are powered via the electrical connector 121 and generate light 117. Referring to FIG. 1B, in a first embodiment of the light emitting device 100, downstream of the LEDs 101, the light 117 passes through the first circular plate 105 and the fluid 111, and exits the light emitting device 100 via the outer surface 121 of the second circular plate 107 as light 119 that is generated by the light emitting device 100. Referring to FIG. 1C, in a second embodiment of the light emitting device 100, downstream of the LEDs 101, the light 117 exits the light emitting device as light that is generated by the light emitting device 100. For this embodiment the fluid 111, the first circular plate 105 and the second circular plate 107 are not light transmissive, or only partially light transmissive. A reflective coating 123 may be present on the outer surface 115 of the first circular plate 105 in order to reflect light generated by the LEDs away from the first circular plate 105. Referring again to FIGS. 1A, 1B and 1C, the heat that is generated locally by the LEDs 101 is conducted to the fluid 111 via the first circular plate 105. The fluid 111 will transfer the heat further to the second circular plate 107 and the wall 109, via conduction as well as via convection within the fluid 111. Said convection is caused by the buoyancy forces resulting from the temperature differences within the fluid 111 between the relative hot spots in the fluid 111 close to the LEDs 101 and the relative cold spots in the fluid 111 close to the second circular plate 107 and the walls 109. Finally, the second circular plate 107 and the walls 109 will the transfer the heat further to the surroundings of the light emitting device 100. The thermally conductive fluid 111 is used in this way to spread the heat that is generated by the LEDs 101 over a relatively large area that is formed by the second circular plate 107 and the wall 109. As the fluid 111 is also optically transmissive, the light 117 that is generated by the LEDs 101 can be transmitted via the fluid 111 to the second circular plate 107 and exit the light emitting device 100 as light 119 (referring to FIG. 1B). The LEDs 101 are not in direct contact with the fluid 111 which makes the light emitting device 100 less complicated as otherwise dedicated measures have to be taken to prevent short-circuiting and/or degradation of materials used in the LEDs 101. The distance $d_1$ between the first circular plate and the second circular plate is 3 mm. In alternative embodiments, a distance $d_1$ of 2, 4, 5, 6, 7, 8, 9 or 10 mm can be chosen. The LEDs 101 are arranged in a matrix in rows and columns. The distance $d_2$ between two neighbouring LEDs 101 is 10 mm. In alternative embodiments, a distance $d_2$ of 5, 6, 7, 8, 9, 11, 12, 13, 14 or 15 mm can be chosen. The distance $d_2$ between two neighbouring LEDs 101 is identical, however in alternative embodiments varying distances between two neighbouring LEDs 101 can be applied. In alternative embodiments, the LEDs 101 can be arranged in other patterns than a matrix in rows and columns, e.g. in a honeycomb structure.

Figure 2A:
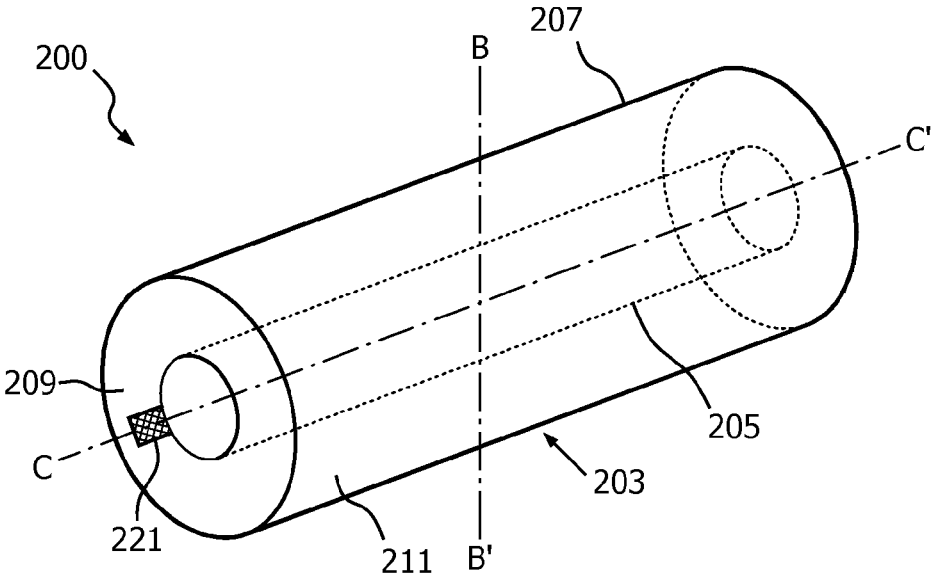
FIGS. 2A, 2B, 2C, 2D and 2E show a fifth, sixth, seventh and eight embodiment of a light emitting device according to the invention.
Figure 2B:
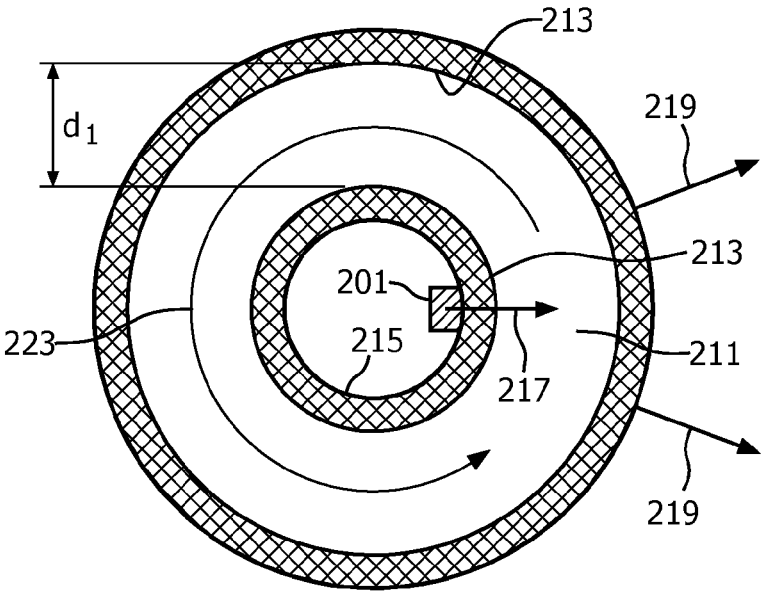
Figure 2C:
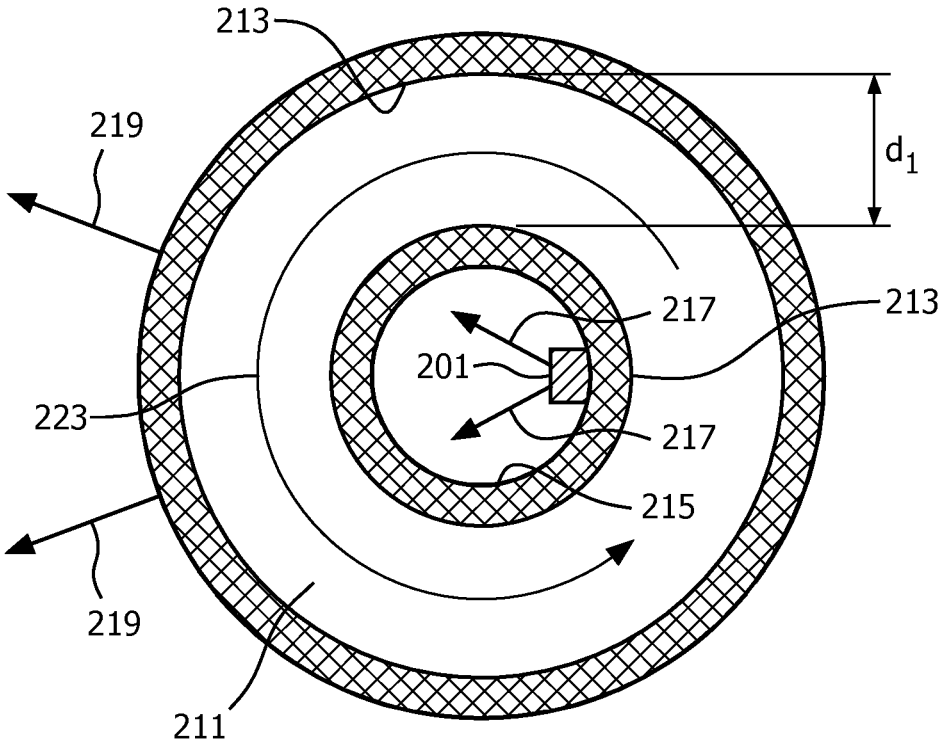
Figure 2D:
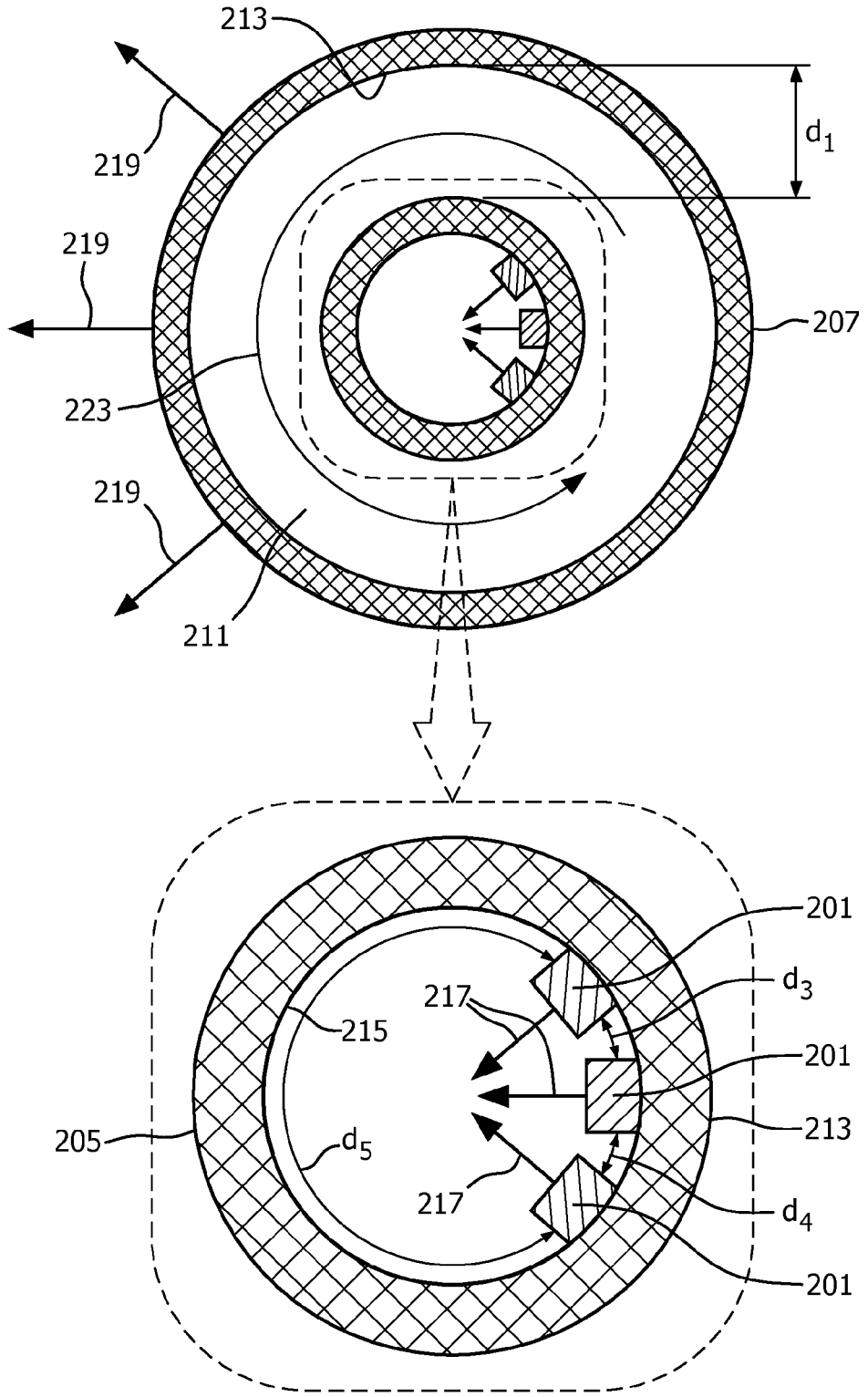

FIG. 2A shows a light emitting device 200 and in FIGS. 2B, 2C, 2D and 2E cross sectional views of the light emitting device 100 along the line B-B' (FIG. 2A) are shown. Referring to FIGS. 2A, 2B, 2C, 2D and 2E, the light emitting device 200 comprises a cylindrical vessel 203. The cylindrical vessel 203 is formed by a first cylindrical vessel 205 and a second cylindrical vessel 207 that are connected via a wall 209. The cylindrical vessel 203 is filled with a heat conducting and light transmissive fluid 211 that is in thermal contact with the inner surface 213 of the first cylindrical vessel 205 as well as the second cylindrical vessel 207. A plurality of LEDs 201 is positioned on the outer surface 215 of the first cylindrical vessel 205 and thermally coupled to the inner surface 213 via the wall of the first cylindrical vessel 205. The LEDs 201 are electrically connected to an electrical connector 221. During operation of the light emitting device 200, the LEDs 201 are powered via the electrical connector 221 and generate light 217. Referring to FIG. 2B, in a first embodiment of the light emitting device 200, the LEDs 201 emit the light 217 towards an outer surface area 215 of the first cylindrical vessel 205 where the LEDs are positioned. The light 217 passes through the fluid 211 and exits the light emitting device 200 via the second cylindrical vessel 207 as light 219 that is genererated by the light emitting device 200. Referring to FIGS. 2C and 2D, in a second and third embodiment of the light emitting device 200, respectively, the LEDs 201 emit the light 217 towards an outer surface area 215 of the first cylindrical vessel 205 facing away from the outer surface 215 where the LEDs 201 are positioned. The light 217 passes through the first cylindrical vessel 205 and the fluid 211, and exits the light emitting device 200 via the second cylindrical vessel 207 as light 219 that is genererated by the light emitting device 200. Referring again to FIGS. 2A, 2B, 2C, 2D and 2E, the heat that is generated locally by the LEDs 201 is conducted to the fluid 211 via the first cylindrical vessel 205. The fluid 211 will transfer the heat further to the second cylindrical vessel 207 and the wall 209 via conduction as well as via convection within the fluid 211. Said convection or movement of the fluid 211 is caused by buoyancy forces in the fluid resulting from the temperature differences within the fluid 211 between the relative hot spots in the fluid 211 close to the LEDs 201 and the relative cold spots in the fluid 211 close to the second cylindrical vessel 207 and the walls 209. Finally, the second cylindrical vessel 207 and the walls 209 will the transfer the heat further to the surroundings of the light emitting device 200. The thermally conductive fluid 211 is used in this way to spread the heat that is generared by the LEDs 101 over a relatively large area that is formed by the second cylindrical vessel 207 and the wall 209. As the fluid 211 is also optically transmissive, the light 217 that is generated by the LEDs 201 can be transmitted via the fluid 211 to the second cylindrical vessel 207 and exit the light emitting device 200 as light 219. The LEDs 201 are not in direct contact with the fluid 211 which makes the light emitting device 200 less complicated as otherwise dedicated measures have to be taken to prevent short-circuiting. The distance $d_1$ between the first cylindrical vessel 205 and the second cylindrical vessel 207 is 3 mm. In alternative embodiments, a distance $d_1$ of 2, 4, 5, 6, 7, 8, 9 or 10 mm can be chosen. The LEDs 201 are arranged in a one linear array. The distance $d_2$ (not shown in FIGS. 2A-2E) between two neighbouring LEDs 201 in the array is 10 mm. In alternative embodiments, a distance $d_2$ of 5, 6, 7, 8, 9, 11, 12, 13, 14 or 15 mm can be chosen. In another alternative embodiment, the LEDs 201 comprises multiple linear arrays of LEDs. The distance $d_2$ (not shown in FIG. 2A-2E) between two neighbouring LEDs in one array 201 is identical, however in alternative embodiments non-identical distances between two neighbouring LEDs 201 can be applied.

Referring to FIGS. 2B, 2C, 2D and 2E, the heat generated by the LEDs 201 is transferred to the liquid 211 via the first cylindrical vessel 205 and as a result the temperature of the liquid 211 near the inside surface 213 of the first cylindrical vessel 205 increases at these location(s). Due to the buoyancy forces, the locally heated liquid 211 starts to move. Finally, this results in a global circulation of the liquid 211 inside the cylindrical vessel 203, as indicated with the arrow 223, without the use of mechanical actuation (so-called thermosyphon effect). As the LEDs 201 are not positioned inside the cylindrical vessel 203, the movement of the liquid 211 is not hampered by the LEDs 201. The heated liquid 211 comes into contact with the wall of the second cylindrical vessel 207 where the heat is transferred, via the wall of the second cylindrical vessel 207, to the surroundings of the light emitting device 200. Due to this thermosyphon effect, the heat removal to the surrounding of the light emitting device 200 is further improved.

Figure 2E:
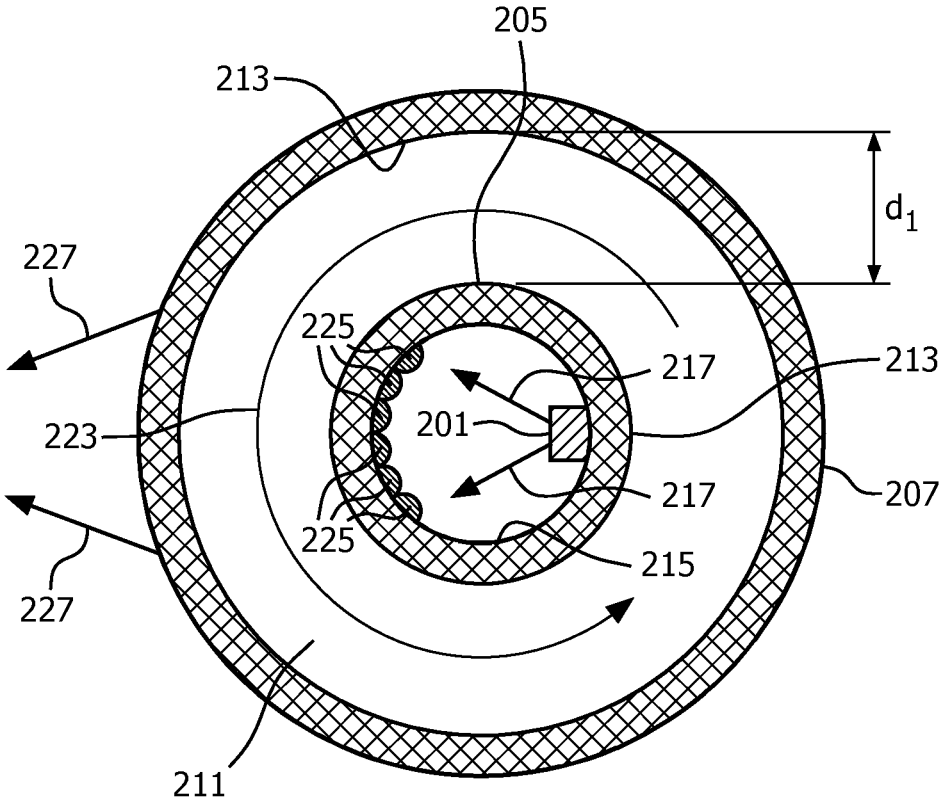

Referring to FIG. 2B, 2C and 2E, the lighting emitting device 200 comprises one array of LEDs 201 that are positioned in parallel to the longitudinal axis C-C' of the first cylindrical vessel 205. Referring to FIG. 2D the light emitting device comprises three arrays of LEDs 201 that are positioned in parallel to the longitudinal axis C-C' of the first cylindrical vessel. The three arrays of LEDs are positioned in a non-symmetrical orientation along the radius of the first tubular vessel 205, i.e. in this embodiment the distances $d_3$ and $d_4$ along the radius are smaller than the distance $d_5$. This non-symmetrical orientation will further intensity the buoyancy forces in the liquid 211 and hence improve the heat transfer to the surroundings of the light emitting device 200.

Figure 3A:
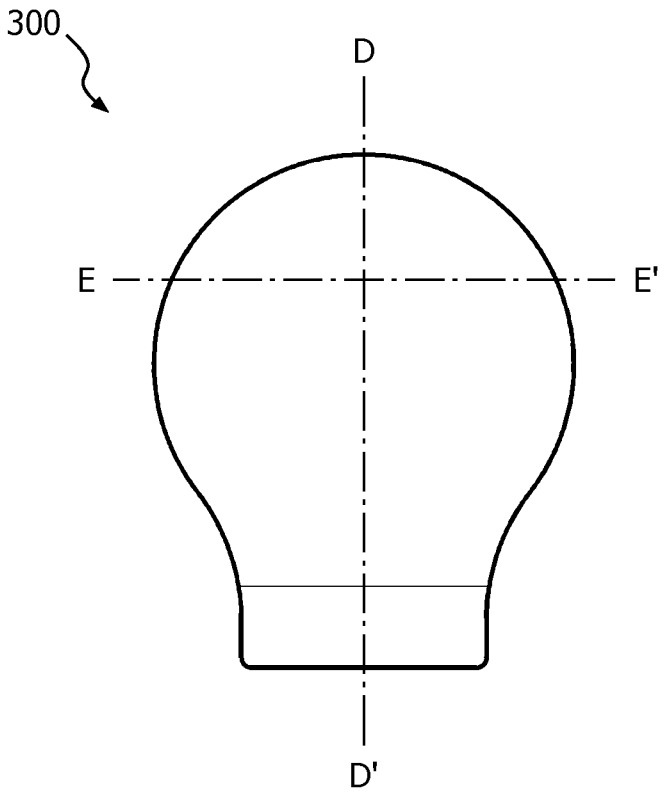
FIGS. 3A, 3B and 3C show a ninth and tenth embodiment of a light emitting device according to the invention.
Figure 3B:
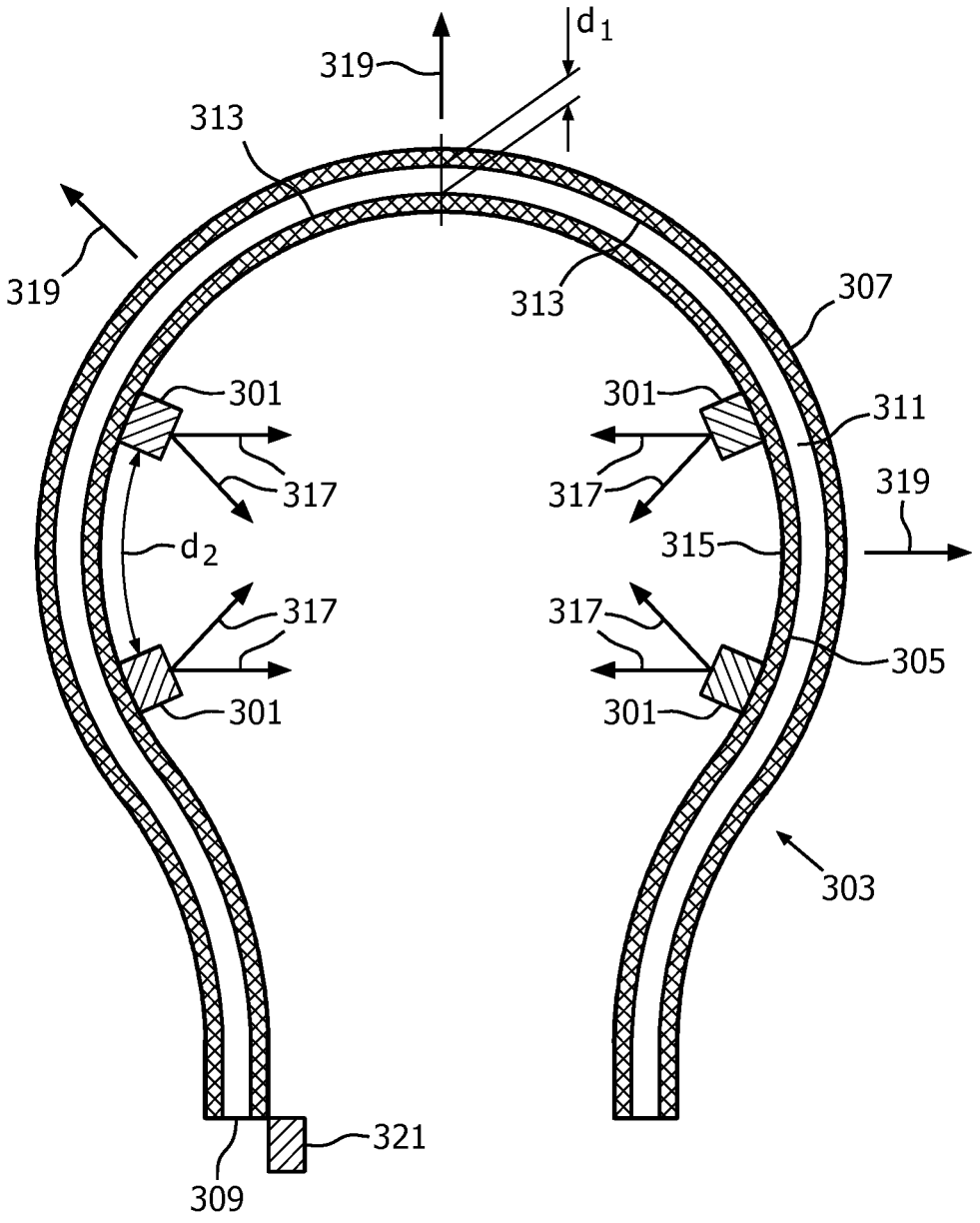
Figure 3C:
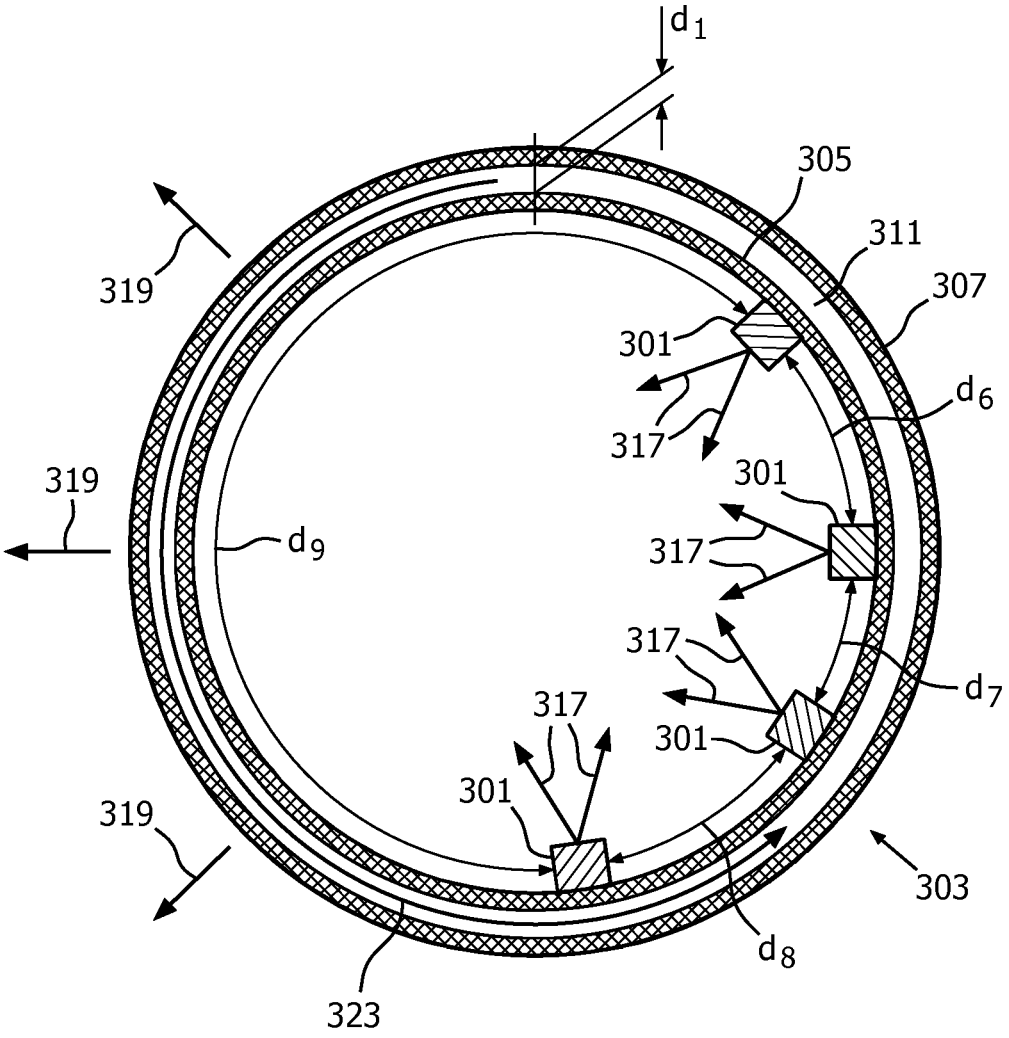

FIG. 3A shows a light emitting device 300, FIG. 3B shows a cross sectional view of the light emitting device 300 along the line D-D' (FIG. 3A) and FIG. 3C shows a cross sectional view of an alternative embodiment of the light emitting device 300 along the line E-E' (FIG. 3A). Referring to FIGS. 3A and 3B, the light emitting device 300 comprises a spherical vessel 303. The spherical vessel 303 is formed by a first spherical vessel 305 and a second spherical vessel 307 that are connected via a wall 309. The spherical vessel 303 is filled with a heat conducting and a light transmissive fluid 311 that is in thermal contact with the inner surface 313 of the first spherical vessel 305 as well as the second spherical vessel 307. A plurality of LEDs 301 is positioned on the outer surface 315 of the first spherical vessel 305 and thermally coupled to the inner surface 313 via the wall of the first spherical vessel 305. The LEDs 301 are electrically connected to an electrical connector 321. During operation of the light emitting device 300, the LEDs 301 are powered via the electrical connector 321 and generate light 317. Downstream of the LEDs 301, the light 317 passes through the first spherical vessel 305, the fluid 311, and exits the light emitting device 300 via the second spherical vessel 307 as light 319 that is generated by the light emitting device 300. The heat that is generated locally by the LEDs 301 is conducted to the fluid 311 via the first spherical vessel 305. The fluid 311 will transfer the heat further to the second spherical vessel 307 and the wall 309, via conduction as well as via convection within the fluid 311. Said convection is caused by the buoyancy forces resulting from the temperature differences within the fluid 311 between the relative hot spots in the fluid 311 close to the LEDs 301 and the relative cold spots in the fluid 311 close to the second spherical vessel 307 and the walls 309. Finally, the second spherical vessel 307 and the walls 309 will the transfer the heat further to the surroundings of the light emitting device 300. The thermally conductive fluid 311 is used in this way to spread the heat that is generated by the LEDs 301 over a relatively large area that is formed by the second spherical vessel 307 and the wall 309. As the fluid 311 is also optically transmissive, the light 317 that is generated by the LEDs 301 can be transmitted via the fluid 311 to the second spherical vessel 307 and exit the light emitting device 300 as light 119. The LEDs 301 are not in direct contact with the fluid 311 which makes the light emitting device 300 less complicated as otherwise dedicated measures have to be taken to prevent short-circuiting and/or degradation of materials used in the LEDs 301. The distance $d_1$ between the first spherical vessel 305 and the second spherical 307 vessel is 3 mm. In alternative embodiments, a distance $d_1$ of 2, 4, 5, 6, 7, 8, 9 or 10 mm can be chosen. The LEDs 301 are arranged in a matrix at various positions along different radii of the first spherical vessel 305. The distance $d_2$ between two neighbouring LEDs 301 is 10 mm. In alternative embodiments, a distance $d_2$ of 5, 6, 7, 8, 9, 11, 12, 13, 14 or 15 mm can be chosen. The distance $d_2$ between two neighbouring LEDs 301 is identical, however in alternative embodiments varying distances between two neighbouring LEDs 301 can be applied. In alternative embodiments, the LEDs 301 can be arranged in alternative patterns.

Referring to FIG. 3C, in an alternative embodiment of the light emitting device 300, the LEDs 301 are positioned along a part of the radius of the spherical vessel 303. The LEDs are positioned in a non-symmetrical orientation, i.e. in this embodiment the distances $d_6$, $d_7$ and $d_8$ along the radius are smaller than the distance $d_9$. The distances $d_6$, $d_7$ and $d_8$ may be substantially identical, or may be different in alternative embodiments. This non-symmetrical orientation will further intensity the buoyancy forces in the liquid 311 and hence improve the heat transfer to the surroundings of the light emitting device 300. The heat generated by the LEDs 301 is transferred to the liquid 211 via the first cylindrical vessel 205 and as a result the temperature of the liquid 311 near the inside surface 313 of the first spherical vessel 305 increases at these location(s). Particularly in case the light emitting device 300 is positioned horizontally along the axis D-D' (FIG. 3A), due to the buoyancy forces, the locally heated liquid 311 starts to move. Finally, this results in a global circulation of the liquid 311 inside the spherical vessel 303, as indicated with the arrow 323, without the use of mechanical actuation (so-called thermosyphon effect). The heated liquid 311 comes into contact with the wall of the second cylindrical vessel 307 where the heat is transferred, via the wall of the second cylindrical vessel 307, to the surroundings of the light emitting device 300. Due to this thermosyphon effect, the heat removal to the surrounding of the light emitting device 300 is further improved. As the LEDs 301 are not positioned inside the spherical vessel 303, the movement of the liquid 311 is not hampered by the LEDs 301.

Figure 4A:
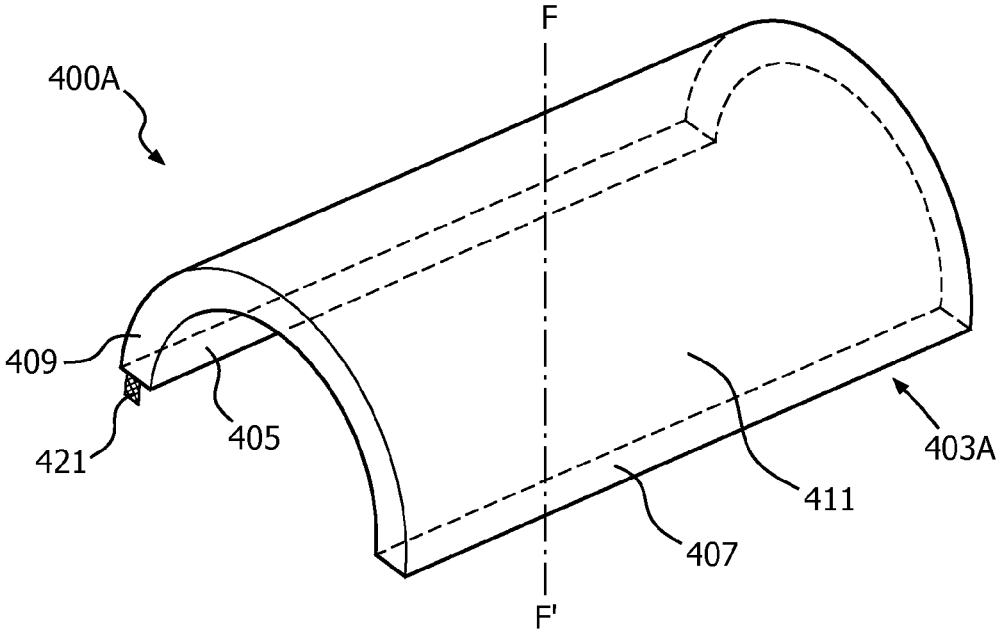
FIGS. 4A, 4B and 4C and 4D show an eleventh, twelfth, thirteenth and fourteenth embodiment of a light emitting device according to the invention.
Figure 4B:
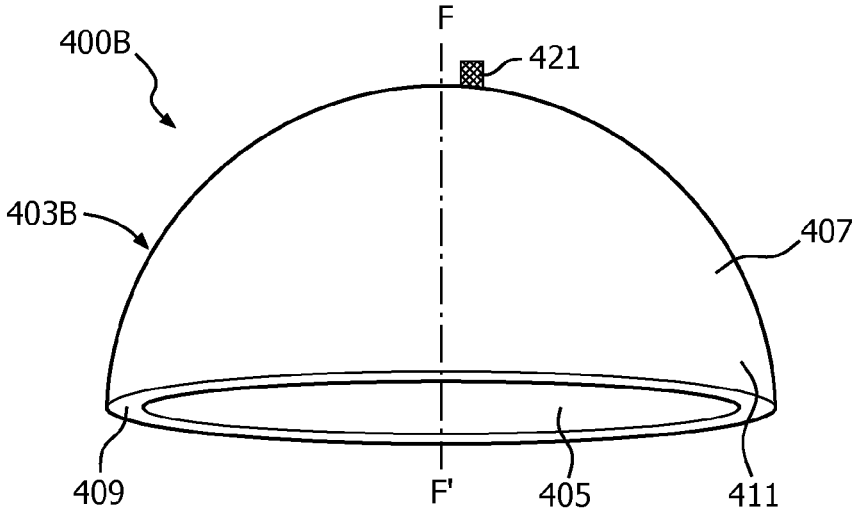
Figure 4C:
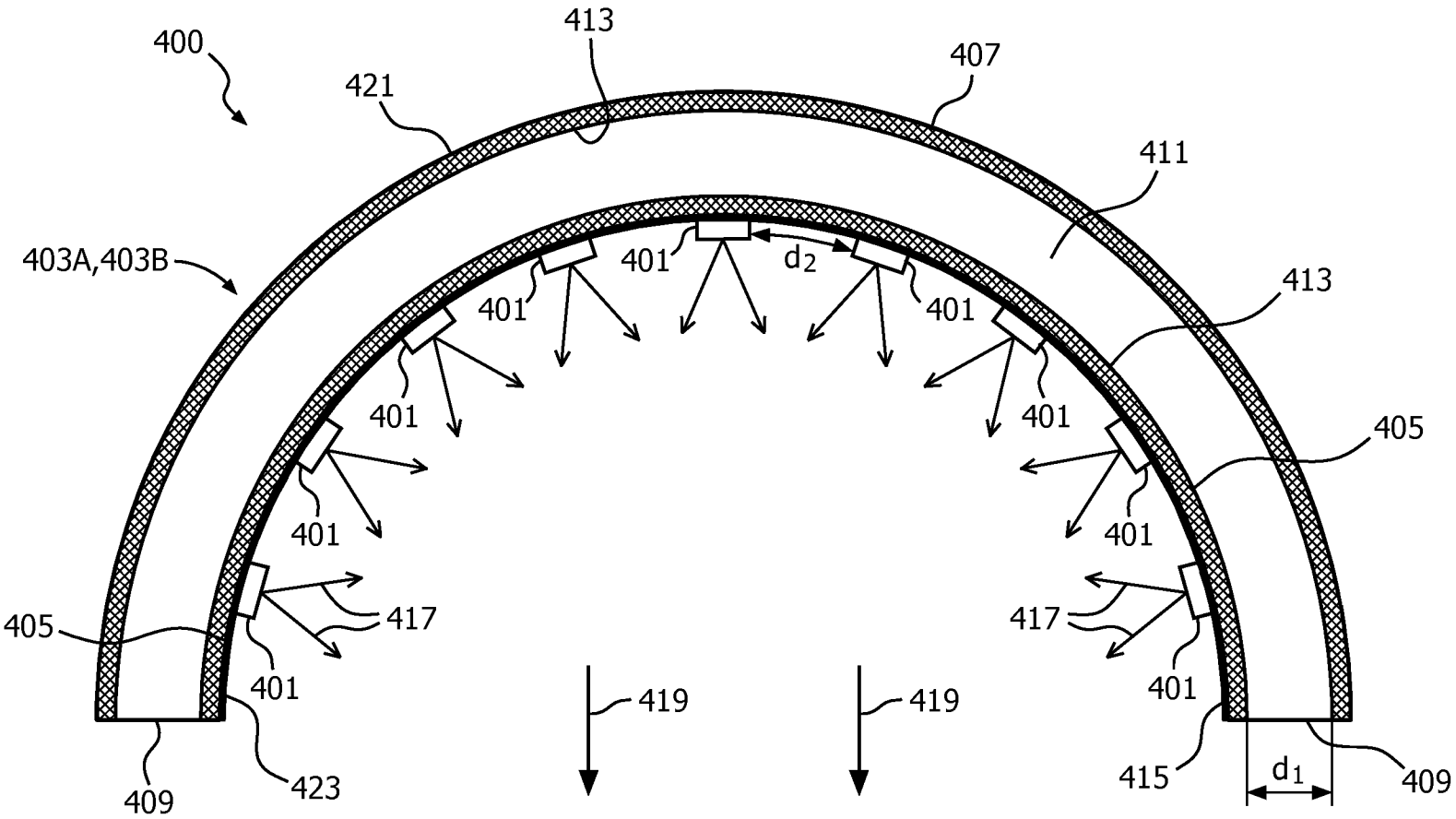
Figure 4D:
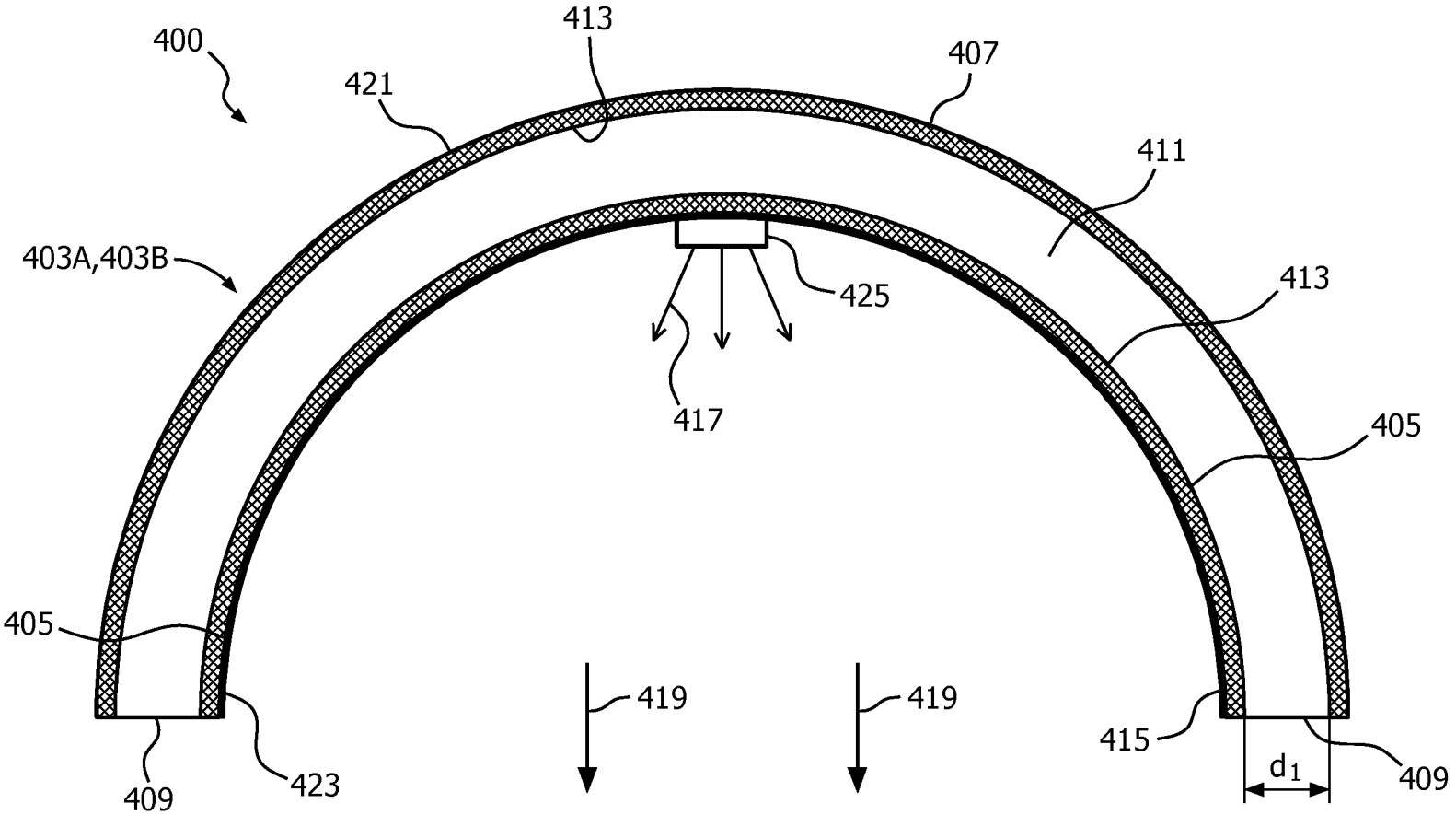

FIG. 4A shows a light emitting device 400A and FIG. 4B shows a light emitting device 400B. FIG. 4C and FIG. 4D show a cross sectional view of the light emitting device 400A, 400B along the line F-F'. Referring to FIG. 4A, 4C and 4D, the light emitting device 400A comprises a half-cylindrical vessel 403A. Referring to FIG. 4B, 4C and 4D, the light emitting device 400B comprises a half-spherical vessel 403B. Referring to FIGS. 4C, the vessels 403A and 403B are formed by a first vessel 405 and a second vessel 407 that are connected via a wall 409. The vessel 403A, 403B is filled with a heat conducting fluid 411 that is in thermal contact with the inner surface 413 of the first vessel 405 as well as the second vessel 407. A plurality of LEDs 401 is positioned on the outer surface 415 of the first vessel 405 and thermally coupled to the inner surface 413 via the wall of the first vessel 405. The LEDs 401 are electrically connected to an electrical connector 421 (FIG. 4A and FIG. 4B). On the outer surface 415 of the first vessel 405 a reflective coating 423 is present. The reflective coating 423 is a specular reflective coating. Alternatively, the reflective coating 423 may be diffusive reflective. During operation of the light emitting device 400A, 400B, the LEDs 401 are powered via the electrical connector 421 and generate light 417. The light 417 may directly exit the light emitting device 400A, 400B, or it may be reflected by the reflective coating 423, generating a light beam 419. The heat that is generated locally by the LEDs 401 is conducted to the fluid 411 via the wall of the first vessel 405. The fluid 411 will transfer the heat further to the second vessel 407 and the wall 409, via conduction as well as via convection within the fluid 411. Said convection is caused by the buoyancy forces resulting from the temperature differences within the fluid 411 between the relative hot spots in the fluid 411 close to the LEDs 401 and the relative cold spots in the fluid 411 close to the second vessel 407 and the walls 409. Finally, the second vessel 407 and the walls 409 will the transfer heat further to the surroundings of the light emitting device 400A, 400B. The thermally conductive fluid 411 is used in this way to spread the heat that is generated by the LEDs 401 over a relatively large area that is formed by the second vessel 407 and the wall 409. The LEDs 401 are not in direct contact with the fluid 411 which makes the light emitting device 400A, 400B less complicated as otherwise dedicated measures have to be taken to prevent short-circuiting and/or degradation of materials used in the LEDs 401. The distance $d_1$ between the first vessel 405 and the second vessel 307 is 3 mm. In alternative embodiments, a distance $d_1$ of 2, 4, 5, 6, 7, 8, 9 or 10 mm can be chosen. The LEDs 401 are arranged in a matrix at various positions along different radii of the first vessel 405. The distance $d_2$ between two neighbouring LEDs 401 is 10 mm. In alternative embodiments, a distance $d_2$ of 5, 6, 7, 8, 9, 11, 12, 13, 14 or 15 mm can be chosen. The distance $d_2$ between two neighbouring LEDs 401 is identical, however in alternative embodiments varying distances between two neighbouring LEDs 401 can be applied. In alternative embodiments, the LEDs 401 can be arranged in alternative patterns.

Referring to FIG. 4D, alternative embodiments of the light emitting device 400A, 400B are identical to that shown in FIGS. 4A and FIG. 4C, and in FIGS. 4B and 4C, respectively, except that instead of the LEDs 401 a so-called Chip-On-Board (COB) LED source 425 is present as a light source. A COB LED source typically comprises multiple LED chips that are packaged together as one light source.

Referring to FIGS. 1A, 2A, 3A, 4A and 4B water is used as the heat conducting fluid. In other embodiments the fluid may comprise silicon oil, methanol, ethanol, acetone, water, a fluorinated aliphatic organic compound, an aromatic organic compound and silicone, or mixtures thereof.

In an alternative embodiments, halogen lamps or high-intensity discharge lamps are used as light sources 101, 201, 301 or 401.

In an alternative embodiment, the heat conductive and light transmissive fluid comprises particles. The particles are selected from the group comprising scattering particles and inorganic luminescent particles, or a combination thereof. Referring to FIGS. 1B, 2B, 2C, 2D, 3B and 3B the light 117, 217 and 317 that is generated by the LEDs 101, 201 and 301 passes through the fluid 111, 211 and 311, respectively, and will be scattered by the scattering particles (not shown in these Figures) that are present in the fluid. As a result, scattered light 119, 219 and 319 exits the light emitting device 100, 200 and 300. In an alternative embodiment, the light 117, 217 and 317 will at least be partly converted to light of another color by inorganic luminescent particles. In a further alternative embodiment, the walls of the first circular plate 105 and/or second circular plate 107 (referring to FIG. 1B), the walls of the first cylindrical vessel 205 and/or the second cylindrical vessel 207 (referring to FIG. 2B, 2C and 2D), and the walls of the first spherical vessel 305 and/or the second spherical vessel 307 (referring to FIG. 3B and 3C), comprise particles (not shown in these Figures) selected from the group comprising scattering particles and inorganic luminescent particles, or a combination thereof. Light 117, 217 and 317 that is generated by the LEDs 101, 201 and 301 passes through these wall(s) and will be scattered by the scattering particles that are present in the wall(s). As a result, scattered light 119, 219 and 319 exits the light emitting device 100, 200 and 300. In an alternative embodiment, the light 117, 217 and 317 will at least be partly converted to light of another color by inorganic luminescent particles. The scattering particles have a particle size in the range of 1-100 μm preferably in the range of 1-10 μm. The scattering particles comprises one or more materials selected from the group of materials comprising polymer materials (e.g. Teflon or PMMA) and hollow spherical particles of a ceramic material (e.g. silica or alumina). In an embodiment, the LEDs 101, 201 and 301 comprise blue light emitting LEDs, and the inorganic luminescent particles comprise a $Al_3A_5O_{12}:Ce^{3+}$ material and optionally an additional $CaAlN_3:Eu^{2+}$ material. A part of the blue light is converted to light of a yellow, or green or yellow/green color that mixes with the non-converted blue light to white light. Optionally red light is added by another luminescent material to generate warm-white light.

In a further alternative embodiment, the optical refractive index of the heat conductive and light transmissive fluid 111, 211 and 311, and the optical refractive index of at least a part of the container 103, 203 and 303 are tuned to each other. The refractive index of the heat conductive fluid ($n_{fluid}$) is in the range of 1-5. The refractive index of the walls of the first circular plate 105 and/or second circular plate 107 (referring to FIG. 1B), the walls of the first cylindrical vessel 205 and/or the second cylindrical vessel 207 (referring to FIG. 2B, 2C and 2D), and the walls of the first spherical vessel 305 and/or the second spherical vessel 307 (referring to FIG. 3B and 3C), ($n_{container}$) respectively, are in the range of 1-5.

By tuning the values of $n_{fluid}$ and $n_{container}$ to each other, a desired optical effect may be achieved. The optical refractive index of the fluid 111, 211, 311 ($n_{fluid}$) is comparable to the optical refractive index of the material ($n_{container}$) of at least a part of the container 103, 203, 303 ($n_{fluid} \approx n_{container}$). In case the light 117, 217, 317 propagates through the fluid 111, 211, 311, subsequently through the second area 107, 207, 307 of the container 103, 203, 303 and then exits the light emitting device 100, 200, 300, the light 117, 217, 317 will not be substantially refracted by the material of the second area 107, 207, 307 of the container 103, 203, 303 and the light emitting device 100, 200, 300 may generate diffuse light. In an alternative embodiment, the optical refractive index of the fluid is larger than the optical refractive index of at least a part of the container ($n_{fluid} > n_{container}$). In case the light propagates through the fluid 111, 211, 311, subsequently through the second area of the container 103, 203, 303 and then exits the light emitting device 100, 200, 300, the light 117, 217, 317 will be substantially refracted by the material of the second area 107, 207, 307 of the container 117, 217, 317 and the light emitting device 100, 200, 300 may generate beam shaped light. The amount of beamshaping is determined by the ratio of $n_{fluid}$ to $n_{container}$; at increasing ratio, for $n_{fluid}>n_{container}$, the amount of beam-shaping increases. In another alternative embodiment the optical refractive index of the fluid is smaller than the optical refractive index of at least a part of the container ($n_{fluid}<n_{container}$). In case the light propagates through the fluid 111, 211, 311, subsequently through the second area 107, 207, 307 of the container 103, 203, 303 and then exits the light emitting device 100, 200, 300, a substantial part of the light 117, 217, 317 will be reflected back by the second area 107, 207, 307 of the container 103, 203, 303 and may exit the light emitting device 100, 200, 300 via the first area 105, 205, 305 of the container 103, 203, 303. The amount of reflected light is determined by the ratio of $n_{fluid}$ to $n_{container}$; at decreasing ratio, for $n_{fluid}<n_{container}$, the amount of reflected light increases.

In a further alternative embodiment, the walls of the first circular plate 105 and/or second circular plate 107 (referring to FIG. 1B), the walls of the first cylindrical vessel 205 and/or the second cylindrical vessel 207 (referring to FIG. 2B, 2C and 2D), and the walls of the first spherical vessel 305 and/or the second spherical vessel 307 (referring to FIG. 3B and 3C), comprise one or more optical elements. Referring to FIG. 2E, optical elements 225 are made on the outer surface area 215 of the first cylindrical vessel 205. The optical elements are microlenses for collimation of light. The LEDs 201 emit the light 217 towards an outer surface area 215 of the first cylindrical vessel 205. Subsequently, the light is collimated by the microlenses 225 and collimated light 227 exits the light emitting device 200 via the second cylindrical vessel 207. Alternatively, the optical elements 225 may comprise one or more elements that comprise a material with a refractive index that is different from the refractive index of the material of the first cylindrical vessel 205 and/or of the fluid 211.

Figure 1D:
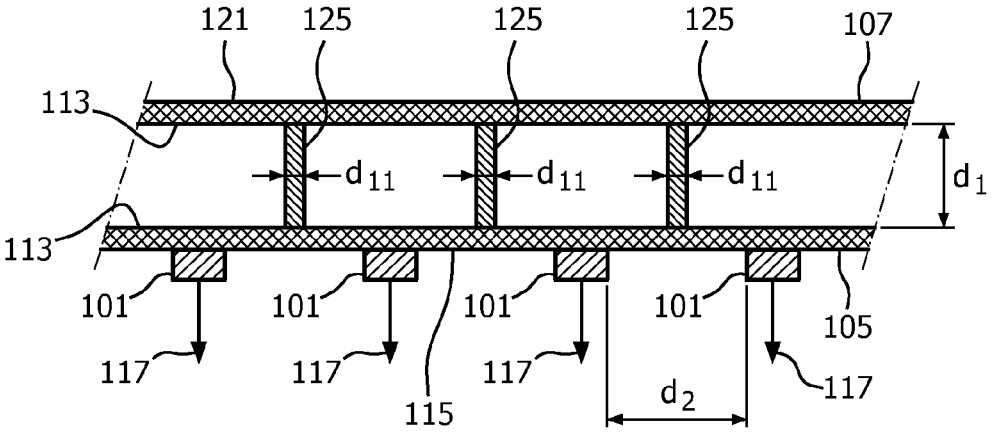
Figure 1E:
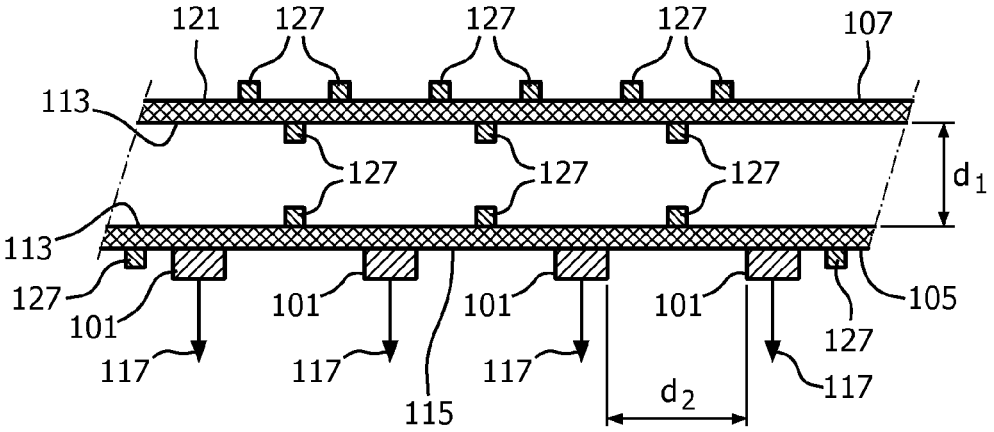

In a further alternative embodiment, the walls of the first circular plate 105 and/or second circular plate 107 (referring to FIG. 1B), the walls of the first cylindrical vessel 205 and/or the second cylindrical vessel 207 (referring to FIG. 2B, 2C and 2D), and the walls of the first spherical vessel 305 and/or the second spherical vessel 307 (referring to FIG. 3B and 3C), comprise one or more elements for increasing the mechanical strength of the walls. In case of light emitting devices having a relatively high output power, for example in the range of 150-600 W, the cooling area (e.g. the area of the inner surface 113 when referring to FIG. 1B) has to be relatively large, for example in the range of 0.5-1 $m^2$. As a result, a relatively large hydrostatic pressure is created on the first circular plate 105 and/or second circular plate 107 (referring to FIG. 1B) and hence also on the cylindrical vessel 103. Referring to FIG. 1D, the first circular plate 105 and the second circular plate 107 comprise elements 125 that are connected to both the first circular plate 105 and the second circular plate 107. The elements 125 have a cylindrical shape with a diameter $d_{11}$ in the range of 2 mm-30 mm. Alternatively, the elements may have different shapes, e.g. triangular or square. The elements 125 may comprise a light transmitting material or alternatively they may comprise a metal that is optionally coated with a reflective coating, such as $TiO_2$. The elements 125 improve the mechanical strength of the light emitting device 100 and by keeping the size (e.g. diameter in case of cylindrical shaped elements 125) relatively small the convection of the fluid 111 during operation of the light emitting device 100 will only be disturbed to a minor extent. Referring to FIG. 1E, in an alternative embodiment, the first circular plate 105 and the second circular plate 107 comprise elongated elements 127 for improving the mechanical strength of the light emitting device 100. The elongated elements 127 are positioned at the (i) inner surface 113 of the first circular plate 105, (ii) the inner surface 113 of the second circular plate 107, (iii) the outer surface 115 of the first circular plate 105 and (iv) the outer surface 121 of the second circular plate 107. Alternatively, the elongated elements 127 are positioned according to one, two or three selection(s) made from the group of (i)-(iv) as indicated in the previous sentence. The elongated elements 127 may extend along the surfaces 113, 115 and 121, or only a part thereof. The elongated elements are preferably made from a light transmitting material, such as for example polycarbonate or another polymer material.

Figure 5:
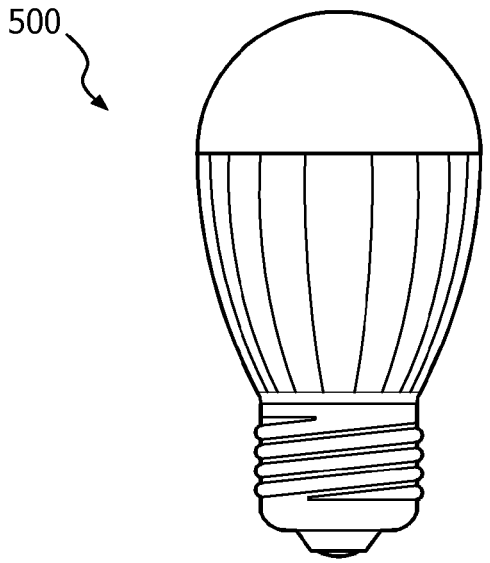
FIG. 5 shows a lamp according to the invention.

FIG. 5 shows a lamp 500 comprising one or more light emitting devices according to FIGS. 1A-1C, FIGS. 2A-2D, FIGS. 3A-3C or FIGS. 4A-4D. The lamp 500 may be used for different applications, such as indoor lighting, outdoor lighting, disinfection purposes, amongst others.

Figure 6:
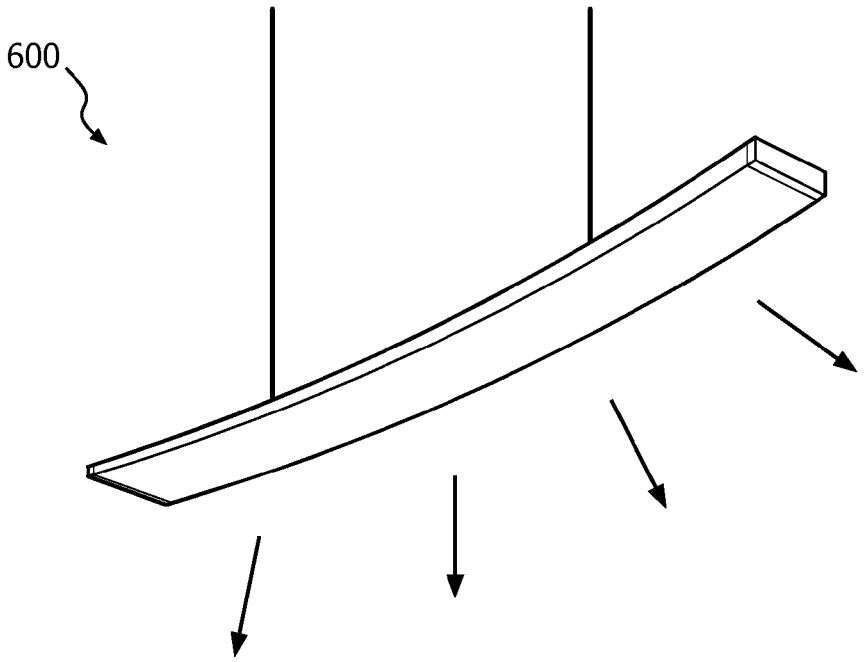
FIG. 6 shows a luminaire according to the invention.

FIG. 6 shows a luminaire 600 comprising one or more light emitting devices according to according to FIGS. 1A-1C, FIGS. 2A-2D, FIGS. 3A-3C, or FIGS. 4A-4D, or one or more lamps according to FIG. 5. The luminaire 600 may be used for different applications, such as indoor lighting, outdoor lighting, disinfection purposes, amongst others.

Figure 7:
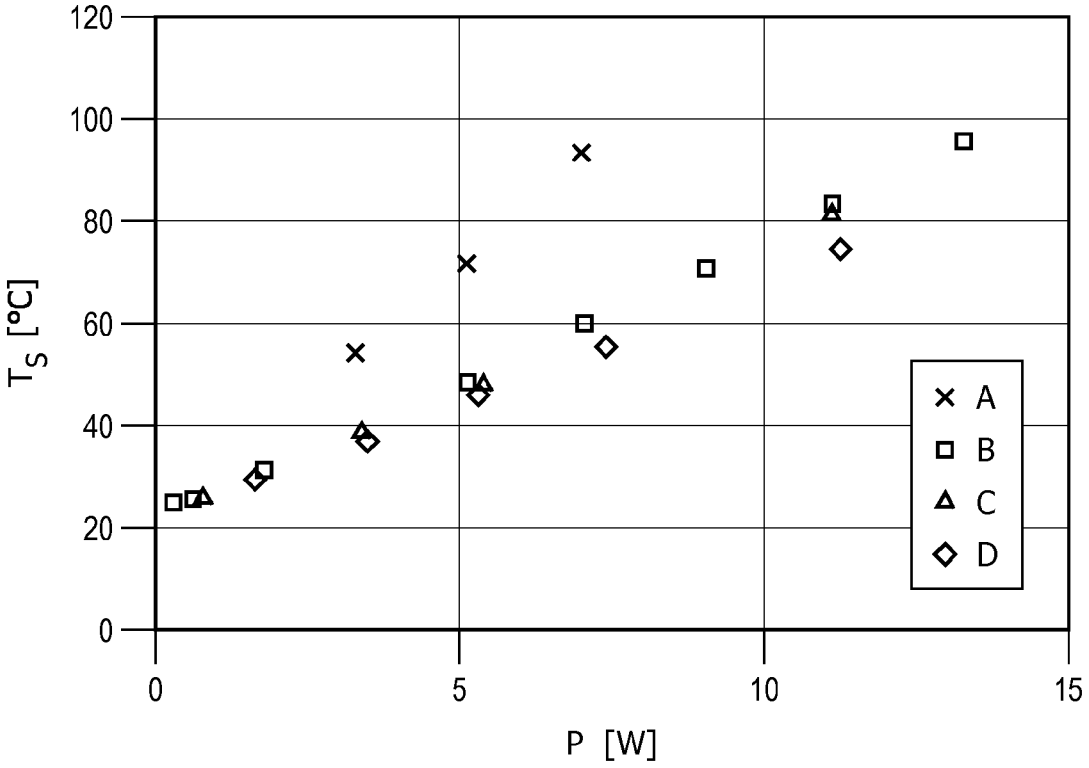
FIG. 7 shows experimental results on the thermal behavior of a light emitting device according to FIGS. 2A and 2C.

FIG. 7 shows the results of thermal experiments that were performed for a light emitting device according to FIGS. 2A and 2C. In FIG. 7 the temperature of the LED footprint in ° C. [$T_s$] is shown versus the electrical power in Watt [P]. The length of the first and second cylindrical vessel 205 and 207, respectively, was 300 mm. One LED array of 240 mm length and comprising 24 LEDs was used. The diameter of the second cylindrical vessel 207 was 20 mm. The diameter of the first cylindrical vessel 205 was varied: 14 mm (referred to as B in FIG. 5, corresponding to a distance $d_1$ of 3 mm), 16 mm (referred to as C in FIG. 6, corresponding to a distance $d_1$ of 2 mm) and 18 mm (referred to as D in FIG. 6, corresponding to a distance $d_1$ of 1 mm). The liquid 211 consists of water. A configuration where a single cylindrical vessel is used with one LED array without using a container with a cooling liquid is referred to as A in FIG. 6. As can be seen from FIG. 6, the light emitting devices according to the invention have a lower value of $T_s$ at comparable electrical power P, compared to the light emitting device without a container with cooling liquid, e.g. about 50° C. versus 70° C. at an electrical power of 5 W. As a result the light emitting devices according to the invention can be driven at a higher electrical power for a given maximum value of $T_s$, e.g. at 13 W versus 7 W for a value of $T_s$ equal to 96° C.

The invention claimed is:

1. A light emitting device, comprising at least one light source and a closed container, the closed container comprising a first area and a second area that is arranged opposite to the first area, the closed container including a cavity being filled with a heat conducting fluid that is thermally coupled to an inside surface of the closed container, wherein the at least one light source is arranged on an outside surface of the first area of the closed container that is outside of said cavity and thermally coupled to the inside surface of the closed container, wherein:

the container comprises a first tubular vessel as the first area and a second tubular vessel as the second area, the second tubular vessel surrounding the first tubular vessel at a distance larger than zero mm, and wherein the space between the first tubular vessel and the second tubular vessel is filled with the heat conducting fluid, or an optical refractive index of the heat conducting fluid is greater than an optical refractive index of at least one of the first area or the second area; and wherein the heat conducting fluid has a Grashof number in the range between $5 \cdot 10^8$-$3 \cdot 10^{10}$.

2. The light emitting device according to claim 1, wherein the heat conducting fluid is light transmissive, and wherein at least a part of the first area and the second area are light transmissive.

3. The light emitting device according to claim 1, wherein the distance is in the range of 1-10 mm.

4. The light emitting device according to claim 1, wherein the heat conducting fluid and/or at least a part of the container comprises at least one of scattering particles or inorganic luminescent particles.

5. The light emitting device according to claim 1, wherein at least a part of the container is made of at least one of a light transmissive organic material, a glass material, a light transmissive ceramic material or a silicone material.

6. The light emitting device according to claim 1, wherein the container comprises one or more optical elements for directing the light emitted during operation of the device in a predetermined direction.

7. The light emitting device according to claim 1, wherein the light source comprises at least one array of light emitting diodes positioned substantially parallel to a longitudinal axis of the first tubular vessel and wherein the distance between two neighboring light emitting diodes is in the range of 5-15 mm.

8. The light emitting device according to claim 7, comprising at least three arrays of light emitting diodes positioned substantially parallel to a longitudinal axis of the first tubular vessel, and wherein the three arrays are positioned in a non-symmetrical distribution along the radius of the first tubular vessel.

9. A lamp comprising at least one light emitting device according to claim 1.

10. A luminaire comprising at least one light emitting device according to claim 1.

11. The light emitting device according to claim 1, wherein the container comprises the first tubular vessel as the first area and the second tubular vessel as the second area, the second tubular vessel surrounding the first tubular vessel at a distance larger than zero mm, and wherein the space between the first tubular vessel and the second tubular vessel is filled with the heat conducting fluid.

12. The light emitting device according to claim 1, wherein the optical refractive index of the heat conducting fluid is greater than the optical refractive index of at least one of the first area or the second area.

13. A light emitting device, comprising at least one light source and a closed container, the closed container comprising a first area and a second area that is arranged opposite to the first area, the closed container being filled with a heat conducting fluid that is thermally coupled to an inside surface of the closed container, wherein the at least one light source is arranged on an outside surface of the first area of the closed container and thermally coupled to the inside surface of the closed container, wherein the heat conducting fluid has a Grashof number in the range between $5 \cdot 10^8$-$3 \cdot 10^{10}$.

14. A heat sink for a light emitting device, comprising a closed container, the closed container comprising a first area and a second area that is arranged opposite to the first area, the closed container including a cavity being filled with a heat conducting and optically transparent fluid that is thermally coupled to an inside surface of the closed container, wherein at least one light source of the light emitting device is arranged on an outside surface of the first area of the closed container that is outside of said cavity, wherein:

the container comprises a first tubular vessel as the first area and a second tubular vessel as the second area, the second tubular vessel surrounding the first tubular vessel at a distance larger than zero mm, and wherein the space between the first tubular vessel and the second tubular vessel is filled with the heat conducting fluid, or:

an optical refractive index of the heat conducting fluid is greater than an optical refractive index of at least one of the first area or the second area; and wherein the heat conducting fluid has a Grashof number in the range between $5 \cdot 10^8$-$3 \cdot 10^{10}$.

15. The heat sink according to claim 14, wherein the container comprises the first tubular vessel as the first area and the second tubular vessel as the second area, the second tubular vessel surrounding the first tubular vessel at a distance larger than zero mm, and wherein the space between the first tubular vessel and the second tubular vessel is filled with the heat conducting fluid.

16. The heat sink according to claim 14, wherein the optical refractive index of the heat conducting fluid is greater than the optical refractive index of at least one of the first area or the second area.

* * * * *